US011850709B2

(12) United States Patent
Chen

(10) Patent No.: US 11,850,709 B2
(45) Date of Patent: Dec. 26, 2023

(54) TOOLBOX HANDLE OF COMBINATION SCREWDRIVER

(71) Applicant: YIH CHENG FACTORY CO., LTD., Nantuo (TW)

(72) Inventor: Wei-Cheng Chen, Nantuo (TW)

(73) Assignee: YIH CHENG FACTORY CO., LTD., Nantuo (TW)

( * ) Notice: Subject to any disclaimer, the term of this patent is extended or adjusted under 35 U.S.C. 154(b) by 123 days.

(21) Appl. No.: 17/568,131

(22) Filed: Jan. 4, 2022

(65) Prior Publication Data

US 2023/0211475 A1 Jul. 6, 2023

(51) Int. Cl.

| | |
|---|---|
| ***B25B 15/02*** | (2006.01) |
| ***B25B 15/00*** | (2006.01) |
| ***B25B 23/16*** | (2006.01) |
| ***B25B 23/00*** | (2006.01) |

(52) U.S. Cl.

CPC ..... *B25B 15/02* (2013.01); *B25B 15/001* (2013.01); *B25B 23/0035* (2013.01); *B25B 23/0042* (2013.01); *B25B 23/16* (2013.01)

(58) Field of Classification Search

CPC ... B25B 15/02; B25B 15/001; B25B 23/0035; B25B 23/0042; B25B 23/16; B25G 1/08; B25G 1/085; B25G 3/12; B25G 3/18; B25H 3/003

USPC ..... 81/177.4, 177.85, 490, 439, 58.3; 206/375, 379; 192/48.92

See application file for complete search history.

(56) References Cited

U.S. PATENT DOCUMENTS

| | | | | |
|---|---|---|---|---|
| 5,875,692 | A * | 3/1999 | Lin | B25G 1/085 81/177.4 |
| 6,601,483 | B2 * | 8/2003 | Wannop | B25G 1/085 81/439 |
| 7,779,732 | B2 * | 8/2010 | Abel | B25G 1/08 81/177.4 |
| 7,950,311 | B2 * | 5/2011 | Chen | B25G 1/085 81/439 |

(Continued)

FOREIGN PATENT DOCUMENTS

| | | |
|---|---|---|
| CN | 202123508 U | 1/2012 |
| EP | 2091682 B1 | 9/2012 |

(Continued)

OTHER PUBLICATIONS

Office Action dated May 24, 2022 of the corresponding Taiwan patent application No. 110143223.

*Primary Examiner* — Don M Anderson
*Assistant Examiner* — Jason Khalil Hawkins
(74) *Attorney, Agent, or Firm* — Chun-Ming Shih; HDLS IPR SERVICES

(57) ABSTRACT

A toolbox handle of a combination screwdriver. A handle includes a barrel and a plate seat. The barrel includes a chamber and an embedding slot. A receiving seat is movably disposed in the chamber and includes an outer sleeve and a resisting base. An outer spring elastically abuts the resisting base. A retractable assembly is inserted in the outer sleeve and includes an inner spring, a positioning rod, and an inner sleeve. A ball is disposed on the positioning recess of the positioning rod to abut the receiving seat. A pressing plate is combined to abut the positioning rod. Therefore, the receiving seat is stably positioned in the handle and is ejectable for use after being pressed.

15 Claims, 5 Drawing Sheets

(56) References Cited

U.S. PATENT DOCUMENTS

| | | | | |
|---|---|---|---|---|
| 9,186,781 | B2 * | 11/2015 | Wang | B25B 15/04 |
| 2011/0138974 | A1 * | 6/2011 | Arslan | B25G 1/085 81/440 |
| 2017/0239807 | A1 | 8/2017 | Gorman et al. | |

FOREIGN PATENT DOCUMENTS

| | | | |
|---|---|---|---|
| TW | 425955 | U | 3/2001 |
| TW | I664061 | B | 7/2019 |

* cited by examiner

TOOLBOX HANDLE OF COMBINATION SCREWDRIVER

BACKGROUND OF THE DISCLOSURE

Technical Field

The technical field relates to a toolbox handle, and more particularly relates to a toolbox handle of a combination screwdriver.

Description of Related Art

A combination screwdriver is provided for users to replace with different screwdriver bits according to the types of screws to be used. In addition, since the types and specifications of screws are diverse, in order to facilitate the storage and carrying of the screwdriver bits and to prevent those from being lost, one way is to use a storage seat in the handle to position multiple screwdriver bits for facilitating the replacement and preventing those from being lost.

Moreover, the receiving seat of the combination screwdriver in the related art is mostly fixed inside the handle by the grasp of elastic claws. However, the receiving seat is not stable under the grasp of the elastic claws. Additionally, the elastic claws are easy to be deformed after being used for a long time or being used repeatedly. As a result, the receiving seat may not be reliably positioned.

In view of the above drawbacks, the inventor proposes this disclosure based on his expert knowledge and elaborate researches in order to solve the problems of related art.

SUMMARY OF THE DISCLOSURE

One object of this disclosure is to provide a toolbox handle of a combination screwdriver, in which the receiving seat may be positioned stably in the handle, and the handle is ejectable after being pressed to increase the convenience of use.

In the embodiment of this disclosure, a toolbox handle of a combination screwdriver includes a handle, a receiving seat, an outer spring, a retractable assembly, a ball, and a pressing assembly. The handle includes a barrel and a plate seat, and an interior of the barrel is separated by the plate seat into a chamber and an embedding slot. The receiving seat is movably disposed in the chamber and includes an outer sleeve and a resisting base. The outer spring elastically abuts the resisting base. The retractable assembly is inserted in the outer sleeve and includes an inner spring, a positioning rod abutted the inner spring, and an inner sleeve adapted to sheathe the positioning rod. A positioning recess is disposed on the positioning rod, and the inner sleeve includes an opening disposed corresponding to the positioning recess. The ball is disposed on the positioning recess and protruding from the opening to abut the receiving seat. The pressing assembly includes a cap and a pressing plate. The cap is disposed in one end of the handle to cover the chamber, and the pressing plate is movably combined with the cap to abut the positioning rod. The pressing plate pushes the positioning rod to compress the inner spring. The positioning rod is moved relative to the inner sleeve. As a result, the ball falls into the positioning recess to release abutment to the receiving seat.

In comparison with the related art, the toolbox handle of the combination screwdriver of this disclosure includes the retractable assembly inserted in the receiving seat, and the ball is disposed on the retractable assembly for abutting against the receiving seat. Thus, the receiving seat is positioned stably in the handle. Furthermore, the retractable assembly is acted under an external force to make the ball to release abutment to the receiving seat. The receiving seat is ejectable from the handle under the restoring force of the spring to increase the practicality.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
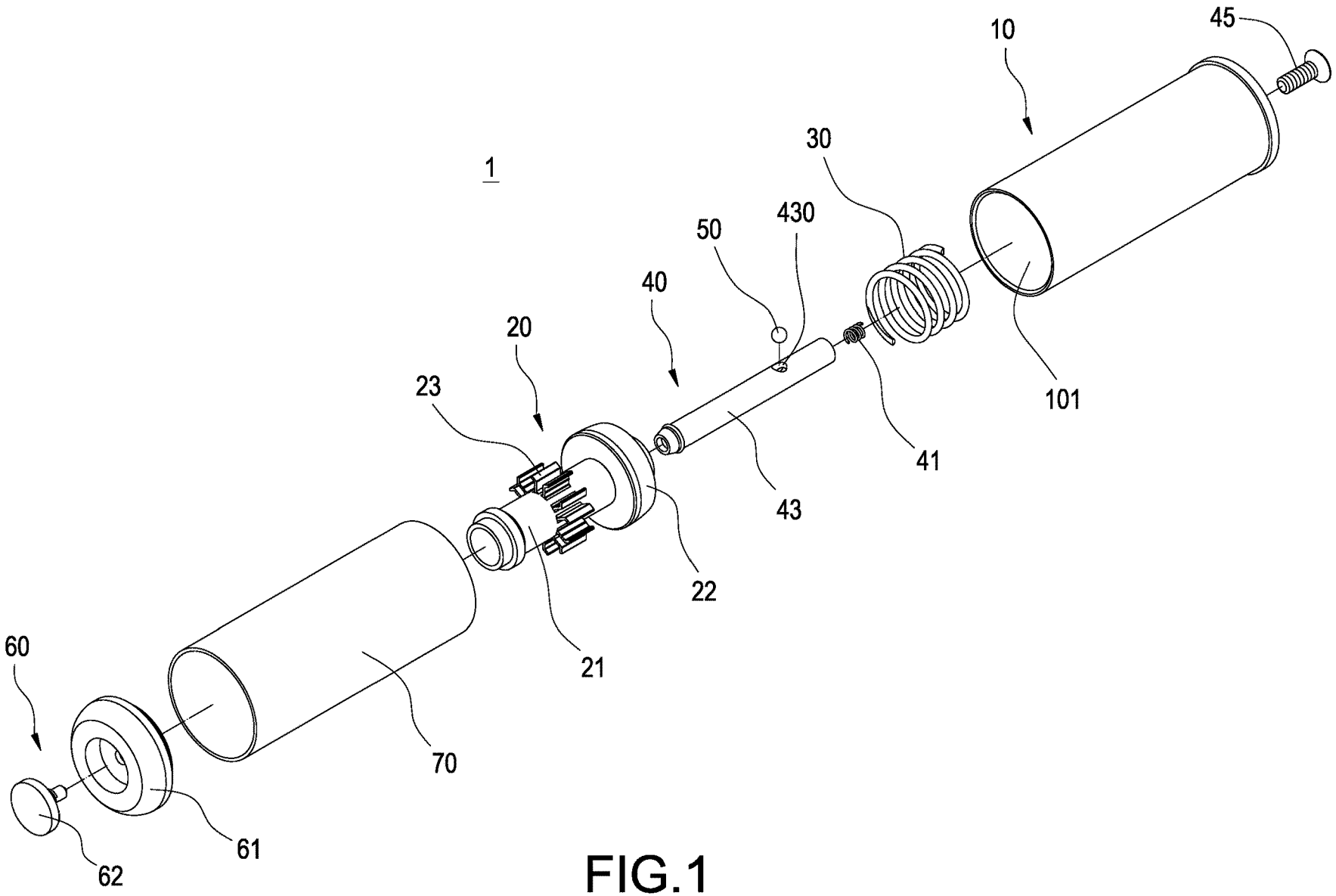
FIG. 1 is a perspective exploded schematic view of the toolbox handle of the combination screwdriver of this disclosure.
Figure 2:
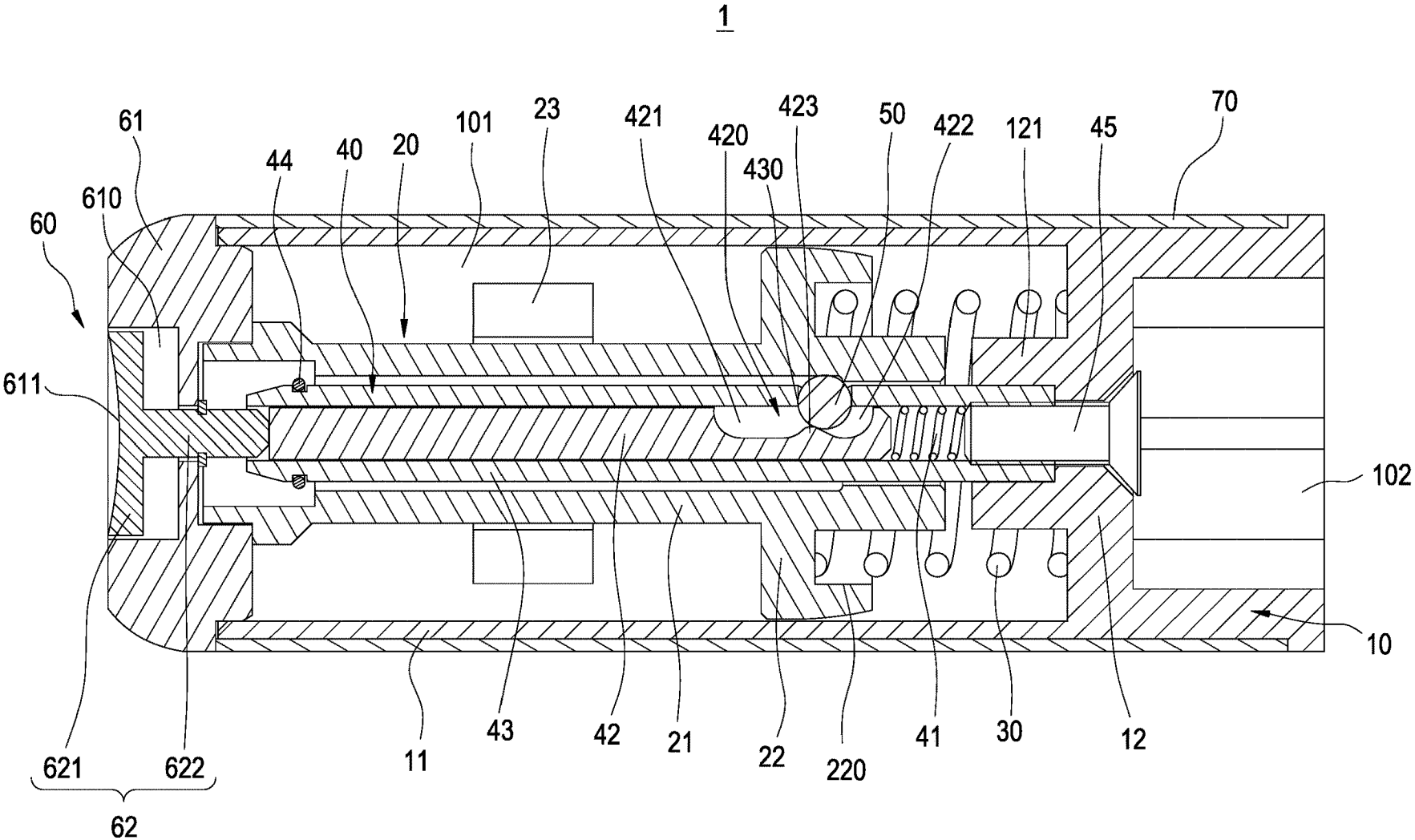
FIG. 2 is a cross sectional view of the toolbox handle of the combination screwdriver of this disclosure.

Please refer to FIG. 1 and FIG. 2, which depict a perspective exploded schematic view and a cross sectional view of the assembly of the toolbox handle of the combination screwdriver of this disclosure. The toolbox handle of the combination screwdriver of this disclosure includes a handle 10, a receiving seat 20, an outer spring 30, a retractable assembly 40, a ball 50 and a pressing assembly 60. The receiving seat 20 elastically abuts the outer spring 30 and is disposed in the handle 10. The retractable assembly 40 is inserted in the receiving seat 20. The ball 50 is movably disposed on the retractable assembly 40 and optionally abuts the receiving seat 20. Furthermore, the pressing assembly 60 is combined with the handle 10 to constitute the toolbox handle 1 of the combination screwdriver. More detailed of the toolbox handle 1 of the combination screwdriver is described as follows.

The handle 10 includes a barrel 11 and a plate seat 12, and an interior of the barrel 11 is separated by the plate seat 12 into a chamber 101 and an embedding slot 102. The embedding slot 102 may be configured as a ratchet wheel slot or other slots for toolbox joints to facilitate the inserting of a ratchet wheel, an extension set or a screwdriver bit (not shown in those figures), etc.

In one embodiment of this disclosure, the toolbox handle 1 further includes a shell 70. The shell 70 is adapted to sheathe the handle 10.

The receiving seat 20 is movably disposed in the barrel 11. The receiving seat 20 includes an outer sleeve 21 and a resisting base 22. Furthermore, the outer spring 30 is disposed on the resisting base 22 and elastically abuts the resisting base 22. In some embodiments, the receiving seat 20 further includes a plurality of elastic clips 23. The elastic clips 23 are arranged annularly on the outer periphery of the outer sleeve 21 for positioning screwdriver bits 2 (refer to FIG. 5).

The retractable assembly 40 is inserted in the outer sleeve 21. The retractable assembly 40 includes an inner spring 41, a positioning rod 42 abutting the inner spring 41 and an inner sleeve 43 adapted to sheathe the positioning rod 42. A positioning recess 420 is disposed on the positioning rod 42, and the inner sleeve 43 includes an opening 430 disposed corresponding to the positioning recess 420. In some embodiments, the retractable assembly 40 further includes a washer 44. The washer 44 is disposed on an outer periphery of the inner sleeve 43.

In one embodiment of this disclosure, the positioning recess 420 includes a first recess 421 and a second recess 422 connected to each other, and a positioning bump 423 is formed between first recess 421 and the second recess 422. In this embodiment, the first recess 421 is an elongated slot, and the second recess 422 is a half arc slot, here is not intended to be limiting.

Specifically, the plate seat 12 of the handle 10 includes a stud 121 disposed on a side thereof facing the chamber 101. Additionally, one end of the inner sleeve 43 is fastened on the stud 121 through a screw 45. Furthermore, a cross section of the resisting base 22 is in a U shape. The resisting base 22 includes an annular slot 220, and one end of the outer spring 30 is located in the annular slot 220.

Moreover, the ball 50 is disposed on the positioning recess 420. The ball 50 protrudes from the opening 430 to abut against the receiving seat 20. Therefore, the receiving seat 20 is accommodated in the chamber 101 of the handle 10 when the receiving seat 20 is abutted by the ball 50.

The pressing assembly 60 includes a cap 61 and a pressing plate 62. The cap 61 is disposed in one end of the handle 10 to cover the chamber 101. The pressing plate 62 is movably combined with the cap 61 to abut the positioning rod 42 of the pressing assembly 60.

Specifically, the pressing plate 62 may be a T-shaped plate. The pressing plate 62 includes a pressing board 621 and a pressing lever 622 connected to the pressing board 621.

In this embodiment, the cap 61 includes a pressing slot 610, and the pressing plate 62 is arranged in the pressing slot 610. The pressing lever 622 is extended to the outer sleeve 21 to abut the positioning rod 42. Moreover, the top surface of the pressing plate 62 does not protrude from the pressing slot 610, and a concave arc surface 611 is disposed on a side of the pressing plate 62 away from the handle 10. The concave arc surface 611 is disposed to facilitate the pressing of the cap 61 for users.

Figure 3:
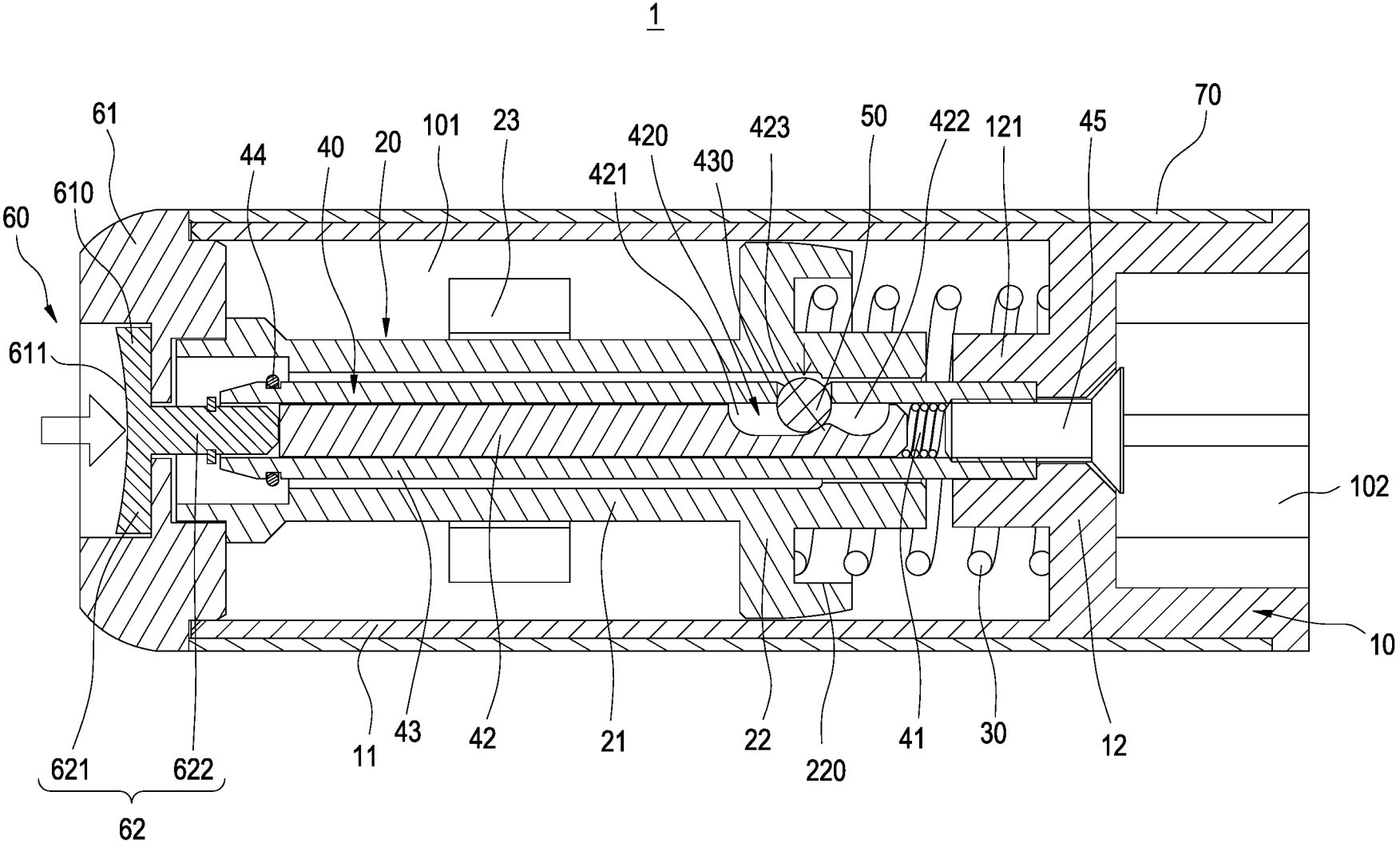
FIG. 3 is a pressing schematic view of the toolbox handle of the combination screwdriver of this disclosure.
Figure 4:
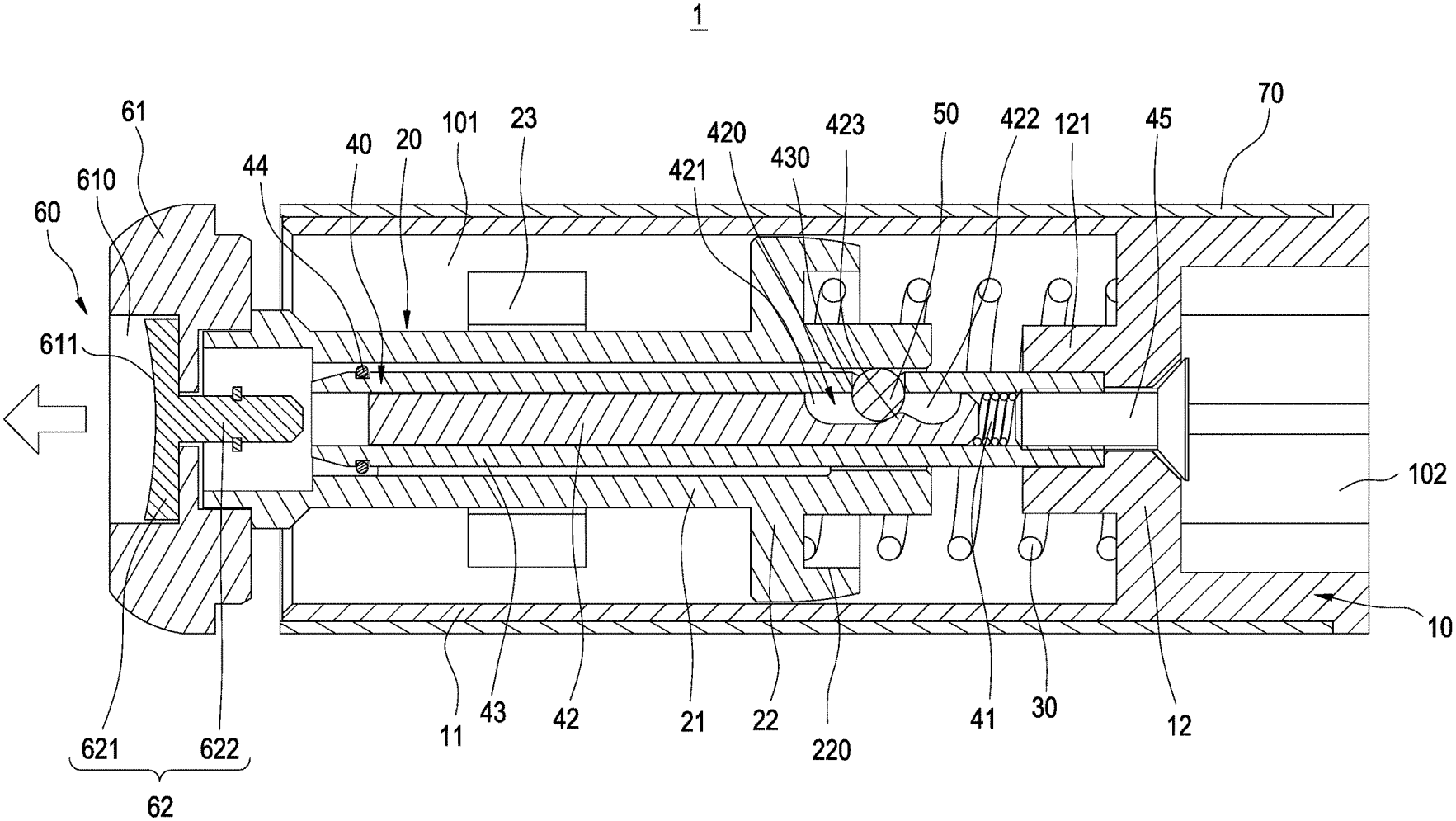
FIG. 4 is an operation schematic view of the retractable assembly of this disclosure.
Figure 5:
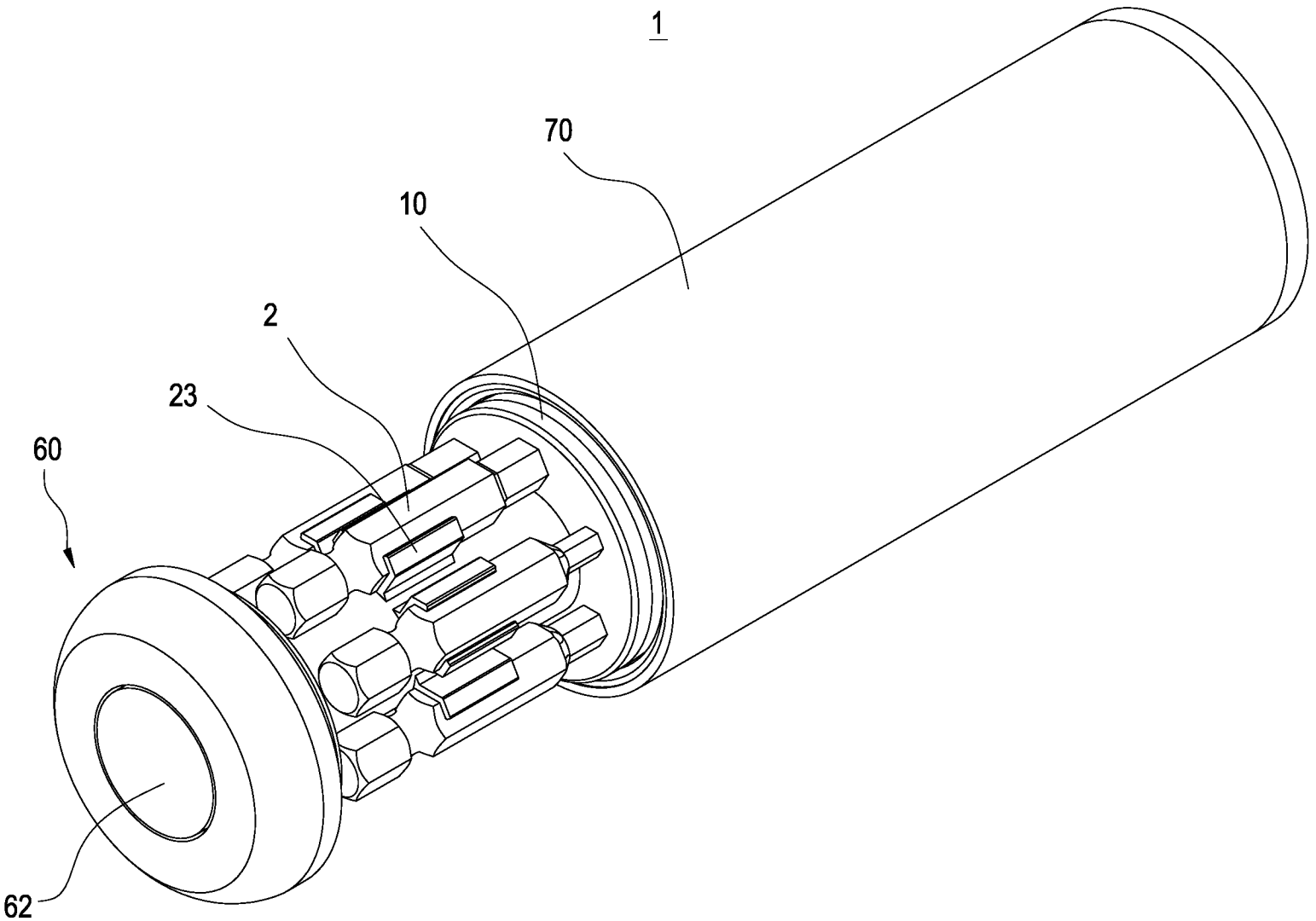
FIG. 5 is an ejection schematic view of the receiving seat of this disclosure.

Please further refer to FIG. 3 to FIG. 5, they depict a pressing schematic view of the toolbox handle of the combination screwdriver of this disclosure, an operation schematic view of the retractable assembly of this disclosure and an ejection schematic view of the receiving seat of this disclosure. The toolbox handle 1 of the combination screwdriver in this disclosure is an ejectable toolbox handle. As shown in FIG. 3, when the toolbox handle 1 is used, a force is exerted to push the pressing plate 62 into the cap 61. The pressing plate 62 pushes the positioning rod 42 to compress the inner spring 41, and the positioning rod 42 is moved relative to the inner sleeve 43. Then the ball 50 falls into the positioning recess 420 with the movement of the positioning rod 42. Specifically, the ball 50 falls into the first recess 421 from the positioning bump 423 to release abutment to the receiving seat 20. Accordingly, as shown in FIG. 4, the receiving seat 20 is moved out of the chamber 101 of the handle 10 under the elastic push of the outer spring 30. Moreover, as shown in FIG. 5, the user may select the screwdriver bit 2 as needed.

It is worth of noting that when the receiving seat 20 is pushed into the handle 10 for positioning, the user also needs to exert force to push the pressing plate 62 into the cap 61. As a result, the pressing plate 62 pushes the positioning rod 42 to move relative to the inner sleeve 43. Then, the ball 50 falls into the second recess 422 with the movement of the positioning rod 42. Furthermore, after the external force is removed, the positioning rod 4 moves back slightly under the restoring force of the inner spring 41. Then the ball 50 returns to the positioning bump 423 from the second recess 422 with the movement of the positioning rod 42 to abut against the receiving seat 20 again. Therefore, the receiving seat 20 is positioned in the handle 10.

While this disclosure has been described by means of specific embodiments, numerous modifications and variations could be made thereto by those skilled in the art without departing from the scope and spirit of this disclosure set forth in the claims.

What is claimed is:

1. A toolbox handle of a combination screwdriver, the toolbox handle comprising:
   - a handle, comprising a barrel and a plate seat, wherein an interior of the barrel is separated into a chamber and an embedding slot by the plate seat;
   - a receiving seat, movably disposed in the chamber and comprising an outer sleeve and a resisting base;
   - an outer spring, elastically abutting the resisting base;
   - a retractable assembly, inserted in the outer sleeve and comprising an inner spring, a positioning rod abutting the inner spring and an inner sleeve adapted to sheathe the positioning rod, wherein a positioning recess is disposed on the positioning rod, the inner sleeve comprising an opening disposed corresponding to the positioning recess, the positioning recess includes a first recess and a second recess connected to each other, and a positioning bump is disposed between the first recess and the second recess;
   - a ball, disposed on the positioning recess and protruded from the opening to abut the receiving seat; and
   - a pressing assembly, comprising a cap and a pressing plate, wherein the cap is disposed on one end of the handle to cover the chamber, and the pressing plate is movably combined with the cap to abut the positioning rod;
   - wherein, the pressing plate is configured to push the positioning rod to compress the inner spring, the positioning rod is moved relative to the inner sleeve, and the ball falls into the positioning recess to be released from abutment to the receiving seat.

2. The toolbox handle according to claim 1, further comprising: a shell, adapted to sheathe the handle.

3. The toolbox handle according to claim 1, wherein the plate seat comprises a stud disposed on a side thereof facing the chamber, and one end of the inner sleeve is fastened on the stud through a screw.

4. The toolbox handle according to claim 1, wherein a cross section of the resisting base is in a U shape, the resisting base comprises an annular slot, and one end of the outer spring is located in the annular slot.

5. The toolbox handle according to claim 1, wherein the first recess comprises an elongated slot, and the second recess comprises a half arc slot.

6. The toolbox handle according to claim 1, wherein the retractable assembly further comprises a washer disposed on an outer periphery of the inner sleeve.

7. A toolbox handle of a combination screwdriver, the toolbox handle comprising:

a handle, comprising a barrel and a plate seat, wherein an interior of the barrel is separated into a chamber and an embedding slot by the plate seat;

a receiving seat, movably disposed in the chamber and comprising an outer sleeve and a resisting base;

an outer spring, elastically abutting the resisting base;

a retractable assembly, inserted in the outer sleeve and comprising an inner spring, a positioning rod abutting the inner spring and an inner sleeve adapted to sheathe the positioning rod, wherein a positioning recess is disposed on the positioning rod, and the inner sleeve comprising an opening disposed corresponding to the positioning recess;

a ball, disposed on the positioning recess and protruded from the opening to abut the receiving seat; and a pressing assembly, comprising a cap and a pressing plate, wherein the cap is disposed on one end of the handle to cover the chamber, and the pressing plate is movably combined with the cap to abut the positioning rod;

wherein the pressing plate is configured to push the positioning rod to compress the inner spring, the positioning rod is moved relative to the inner sleeve, and the ball falls into the positioning recess to be released from abutment to the receiving seat;

wherein the pressing plate is a T-shaped plate, and the pressing plate comprises a pressing board and a pressing lever connected to the pressing board.

8. The toolbox handle according to claim 7, wherein the cap comprises a pressing slot, and the pressing plate is arranged in the pressing slot, and the pressing lever is extended to the outer sleeve to abut the positioning rod.

9. The toolbox handle according to claim 8, wherein a top surface of the pressing plate is free from protruding the pressing slot, and a concave arc surface is disposed on a side of the pressing plate away from the handle.

10. The toolbox handle according to claim 7, further comprising: a shell, adapted to sheathe the handle.

11. The toolbox handle according to claim 7, wherein the plate seat comprises a stud disposed on a side thereof facing the chamber, and one end of the inner sleeve is fastened on the stud through a screw.

12. The toolbox handle according to claim 7, wherein a cross section of the resisting base is in a U shape, the resisting base comprises an annular slot, and one end of the outer spring is located in the annular slot.

13. The toolbox handle according to claim 7, wherein the positioning recess includes a first recess and a second recess connected to each other, and a positioning bump is disposed between the first recess and the second recess.

14. The toolbox handle according to claim 13, wherein the first recess comprises an elongated slot, and the second recess comprises a half arc slot.

15. The toolbox handle according to claim 7, wherein the retractable assembly further comprises a washer disposed on an outer periphery of the inner sleeve.

* * * * *